United States Patent [19]

Poehlman

[11] Patent Number: 4,836,453

[45] Date of Patent: Jun. 6, 1989

[54] FUEL INJECTOR WITH CONTINUOUS AIR FLOW

[75] Inventor: Arthur G. Poehlman, West Bend, Wis.

[73] Assignee: Outboard Marine Corporation, Waukegan, Ill.

[21] Appl. No.: 158,943

[22] Filed: Feb. 22, 1988

[51] Int. Cl.[4] ..... B05B 7/12

[52] U.S. Cl. ..... 239/408; 239/412; 239/417.3; 239/585

[58] Field of Search ..... 239/407, 408, 410, 412, 239/417.3, 451, 453, 456, 533.2, 533.3, 533.12, 585

[56] References Cited

U.S. PATENT DOCUMENTS

| | | | |
|---|---|---|---|
| 960,057 | 5/1910 | Turnbull, Jr. . | |
| 1,163,671 | 12/1915 | Kraus . | |
| 1,511,820 | 10/1924 | Rochefort . | |
| 1,526,923 | 2/1925 | Meden . | |
| 1,767,462 | 6/1930 | Lammert et al. | 239/417.3 |
| 1,901,848 | 3/1933 | Moore . | |
| 2,069,346 | 2/1937 | Wilka . | |
| 2,482,864 | 9/1949 | Nemnich . | |
| 2,530,206 | 11/1950 | Nieburg . | |
| 2,674,984 | 4/1954 | Bondi | 239/453 X |
| 3,498,545 | 3/1970 | Short . | |
| 3,671,025 | 6/1972 | Elliott . | |
| 3,770,208 | 11/1973 | Mueller | 239/417.3 |
| 3,771,727 | 11/1973 | Robic | 239/417.3 |
| 3,782,639 | 1/1974 | Boltz et al. . | |
| 3,790,086 | 2/1974 | Masai . | |
| 3,913,845 | 10/1975 | Tsuji . | |
| 4,006,719 | 2/1977 | Kanada et al. . | |
| 4,046,121 | 9/1977 | Pierlot . | |
| 4,167,921 | 9/1979 | Steinwart . | |
| 4,168,018 | 9/1979 | Zahaykevich . | |
| 4,190,030 | 2/1980 | Chester . | |
| 4,216,174 | 8/1980 | Szott et al. . | |
| 4,216,753 | 8/1980 | Inoue et al. . | |
| 4,288,037 | 9/1981 | Shelhas | 239/533.2 X |
| 4,351,304 | 9/1982 | Schweizer | 239/417.3 X |
| 4,434,766 | 3/1984 | Matsuoka et al. . | |
| 4,545,354 | 10/1985 | Jaggle et al. . | |

FOREIGN PATENT DOCUMENTS

| | | | |
|---|---|---|---|
| 107665 | 7/1917 | United Kingdom | 239/417.3 |
| 529316 | 11/1940 | United Kingdom | 239/417.3 |

*Primary Examiner*—Andres Kashnikow
*Assistant Examiner*—Michael J. Forman
*Attorney, Agent, or Firm*—Michael, Best & Friedrich

[57] ABSTRACT

A fuel injector nozzle comprising an inner member including an axially extending fuel passage adapted to communicate with a source of fuel under pressure and having an outlet end with a surface defining a valve seat, and an outer surface extending axially outwardly and converging to the valve seat, a valve member located in the fuel passage and movable axially thereof relative to the valve seat between open and closed positions, which valve member includes a valve head which is engageable with the valve seat when the valve member is in the closed position and spaced from the valve seat when the valve member is in the open position, and which includes an axially outwardly extending and converging surface, and an outer member surrounding the inner member and the valve head in spaced relation thereto and defining therebetween an air flow passage adapted to communicate with a source of air under pressure, which outer member includes an axially outwardly extending and converging surface located in spaced relation to the outer surface of the inner member and to the converging surface of the valve head and forming, with the outer surface of the inner member and the converging surface of the valve head, an air flow passage portion which diverges axially outwardly and which communicates with the fuel passage when the valve seat is in the open position, which outer member also includes an annular distribution chamber forming a part of the air flow passage, and an air flow duct forming a part of the air flow passage and communicating with the distribution chamber and with the environment exterior to the outer member.

5 Claims, 1 Drawing Sheet

FUEL INJECTOR WITH CONTINUOUS AIR FLOW

BACKGROUND OF THE INVENTION

The invention relates generally to fuel injectors. More particularly, the invention relates to fuel injectors which mix fuel and air prior to introduction of the mixture into an engine cylinder.

Still more particularly, the invention relates to such fuel injectors which are particularly adapted for use with spark ignition, two-stroke internal combustion engines.

Attention is directed to the following U.S. patents:

| | | |
|---|---|---|
| 960,057 | T. Tunbull, Jr. | May 31, 1910 |
| 1,163,671 | O. Kraus | December 14, 1915 |
| 1,511,820 | F. Rochefort | October 14, 1924 |
| 1,526,923 | E. H. Meden | March 18, 1920 |
| 1,767,462 | G. C. Lammert, et al. | January 31, 1927 |
| 1,901,848 | A. Moore | September 5, 1928 |
| 2,069,346 | G. A. Wilka | May 4, 1934 |
| 2,482,864 | G. Nemnich | September 27, 1949 |
| 2,530,206 | F. Nieburg | November 14, 1950 |
| 3,498,545 | R. V. Short | March 3, 1970 |
| 3,671,025 | P. R. Elliott | June 20, 1972 |
| 3,770,208 | G. H. Mueller | November 6, 1973 |
| 3,771,727 | G. Robic | November 13, 1973 |
| 3,782,639 | R. R. Boltz, et al. | January 1, 1974 |
| 3,790,086 | T. Masai | February 5, 1974 |
| 3,913,845 | S. Tsuji | October 21, 1975 |
| 4,006,719 | Kanada, et al. | February 8, 1977 |
| 4,046,121 | M. E. Pierlot | September 6, 1977 |
| 4,167,921 | J. Steinwart | September 18, 1979 |
| 4,168,018 | Zahaykevich | September 18, 1979 |
| 4,190,030 | J. D. Chester | February 26, 1980 |
| 4,216,174 | R. Szott, et al. | August 5, 1980 |
| 4,216,753 | T. Inoue, et al. | August 12, 1980 |
| 4,288,037 | P. Schelhas | September 8, 1981 |
| 4,351,304 | K. Schweizer | September 28, 1982 |
| 4,434,766 | H. Matsuoka, et al. | March 6, 1984 |
| 4,545,354 | G. Jaggle, et al. | October 8, 1985 |

SUMMARY OF THE INVENTION

The invention provides a fuel injector assembly comprising means defining a valve-free air flow passage adapted to communicate with a source of gas under substantially constant pressure and with a combustion chamber, and a fuel passage communicating with the air flow passage and including selectively operable means for discharging fuel into the air flow passage for atomization and travel with the gas into the combustion chamber.

The invention also provides a fuel injector nozzle comprising an inner member including an axially extending fuel passage adapted to communicate with a source of fuel under pressure and having an outlet end with an axially outwardly diverging frustro-conical inner surface defining a valve seat, said inner member also including a frustro-conical outer surface converging to said diverging frustro-conical inner surface, an outer member surrounding said inner member in spaced relation thereto and defining therebetween an air flow passage adapted to communicate with a source of air under pressure, said outer member including an axially outwardly extending and converging frustro-conical surface located in spaced relation to said frustro-conical outer surface of said inner member and forming, with said frustro-conical outer surface of said inner member, a first diverging portion of said air flow passage, and a valve member located in said fuel passage and movable axially thereof relative to said valve seat between open and closed positions, said valve member comprising a valve head including an axially outwardly diverging frustro-conical surface engagable with said valve seat when said valve member is in said closed position and spaced from said valve seat when said valve member is in said open position, said valve head also including an axially outwardly extending converging conical surface located in spaced relation to said frustro-conical surface of said outer member and forming, with said frustro-conical surface of said outer member, a second diverging portion of said air flow passage, said second diverging air flow passage portion communicating with said first diverging air flow passage portion and with the environment exterior to the outer member.

The invention also provides a fuel injector nozzle comprising an inner member including an axially extending fuel passage adapted to communicate with a source of fuel under pressure and having an outlet end with an axially outwardly diverging frustro-conical inner surface defining a valve seat, which inner member also includes an endless outer surface and a frustro-conical outer surface converging from the outer surface to the diverging frustro-conical inner surface, an outer member surrounding the endless outer surface of the inner member in spaced relation thereto and defining therebetween an air flow passage adapted to communicate with a source of air under pressure, which outer member includes an axially outwardly extending and converging frustro-conical surface located in spaced relation to the frustro-conical outer surface of the inner member and forming, with the frustro-conical outer surface of the inner member, a first diverging portion of the air flow passage, the first divergent air flow passage portion having an entry end constituting a restriction to air flow and an outlet end, which outer member also includes, axially outwardly of the frustro-conical surface thereof, an annular distribution chamber forming a part of the air flow passage, and which outer member also includes an air flow duct forming a part of the air flow passage and communicating with the distribution chamber and with the environment exterior to the outer member, and a valve member located in the fuel passage and movable axially thereof relative to the valve seat between open and closed positions, which valve member comprises a valve head including an axially outwardly diverging frustro-conical surface engagable with the valve seat when the valve member is in the closed position and spaced from the valve seat when the valve member is in the open position, which valve head also includes an axially outwardly extending converging conical surface located above the distribution chamber and in spaced relation to the frustro-conical surface of the outer member and forming, with the frustro-conical surface of the outer member, a second diverging portion of the air flow passage, which second diverging air flow passage portion includes an entry end communicating with the outlet end of the first diverging air flow passage portion and an outlet end communicating with the distribution chamber.

The invention also provides a fuel injector comprising first annular wall means defining an axially extending fuel passage adapted to communicate with a source of fuel under pressure and including an outlet end having an axially outwardly diverging frustro-conical inner surface defining a valve seat, which first annular wall means also includes an endless outer surface and a frustro-conical outer surface converging from the outer wall surface to the frustro-conical inner surface, a valve member located in the fuel passage and movable axially thereof relative to the valve seat between open and closed positions, which valve member comprises a valve head including an axially outwardly diverging frustro-conical surface engagable with the valve seat when the valve member is in the closed position and spaced from the valve seat when the valve member is in the open position, which valve head also includes an axially outwardly extending converging conical surface, and second annular wall means surrounding the endless outer surface of the first annular wall means in spaced relation thereto and defining therebetween an air flow passage adapted to communicate with a source of air under pressure, which second annular wall means defines an axially outwardly extending and converging frustro-conical surface located in spaced relation to the frustro-conical outer wall surface of the first annular wall means and forms, with the frustro-conical outer surface of the first annular wall means, a first diverging portion of the air flow passage, which first divergent air flow passage portion has an entry end constituting a restriction to air flow and an outlet end, which converging frustro-conical surface provided by the second annular wall means is located in spaced relation to the conical surface of the valve head and forms, with the conical surface of the valve head, a second diverging portion of the air flow passage, which second diverging air flow passage portion includes an entry end communicating with the outlet end of the first diverging air flow passage portion and an outlet end, which second annular wall means also defines, axially outwardly of the conical portion of the valve head, an annular distribution chamber forming a part of the air flow passage and communicating with the outlet end of the second diverging air flow passage portion, and which second annular wall means also defines an air flow duct forming a part of the air flow passage and communicating with the distribution chamber and with the environment exterior to the second annular wall means.

Other features and advantages of the invention will become apparent to those skilled in the art upon review of the following detailed description, claims and drawings.

Figure 1:
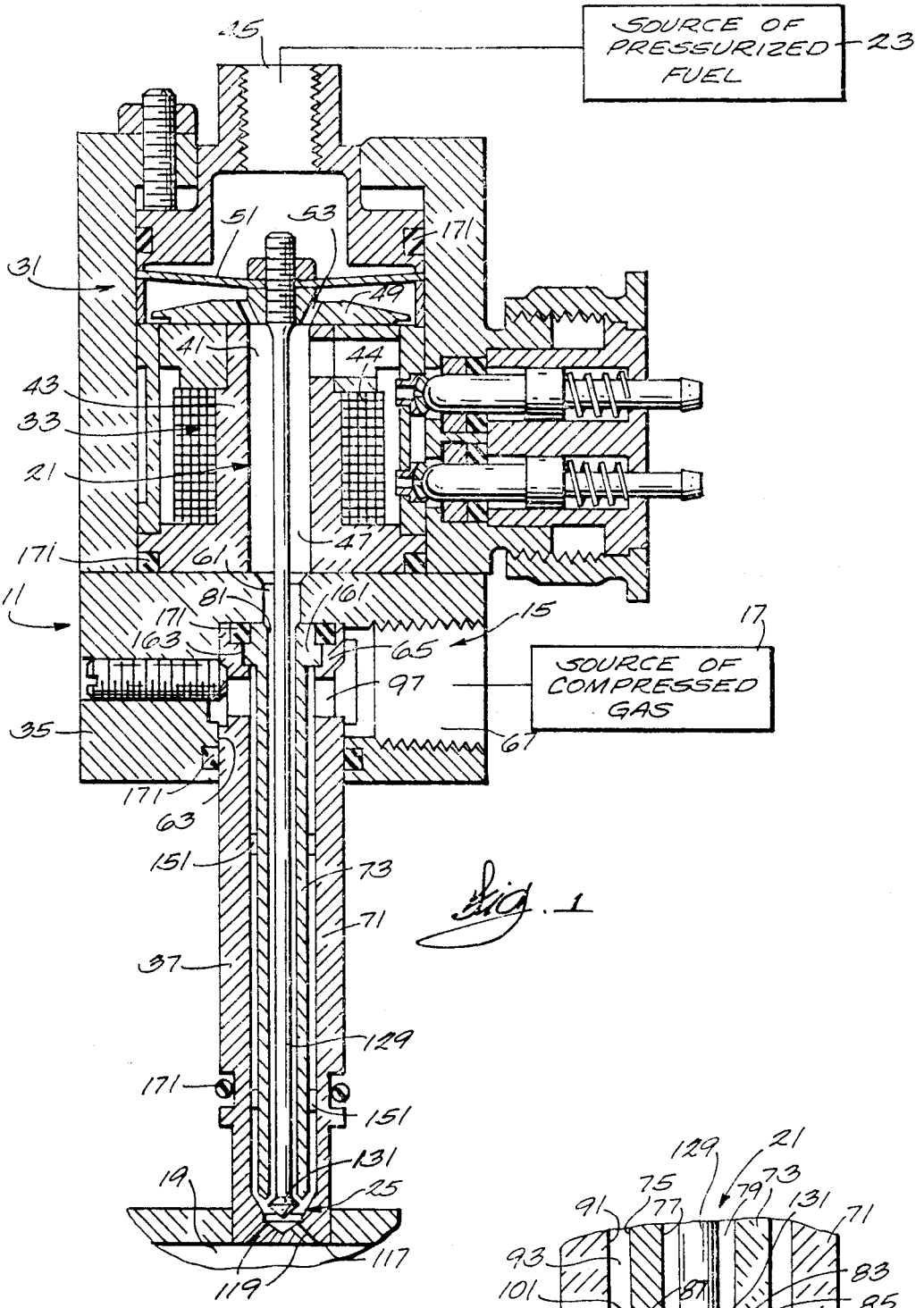
FIG. 1 is a sectional view of a fuel injector incorporating various of the features of the invention.
Figure 2:
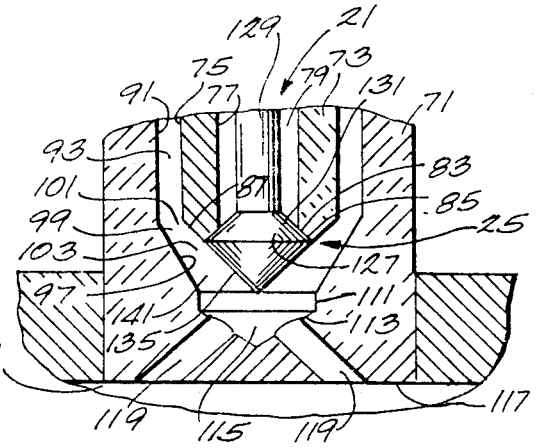
FIG. 2 is an enlarged fragmentary view of a portion of the fuel injector shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a continuous air flow atomizing fuel injector 11 including wall means defining an un-valved or valve free air passage 15 communicating between a suitable source 17 of compressed gas, preferably substantially air, and the interior of an engine cylinder 19, and a fuel passage 21 communicating with a suitable source 23 of fuel under pressure and communicable through a selectively operable fuel control valve 25 with the air flow passage 15. The compressed gas source 17 can be an engine driven compressor (not shown).

Various physical constructions can be employed to obtain the air flow and fuel flow passages 15 and 21, respectively. In the disclosed construction, the fuel injector 11 includes a valve body 31 which includes a solenoid valve operating mechanism 33 and which is suitably attached or connected to an intermediate component 35 which, in turn, is suitably attached or connected to an elongated injector nozzle 37.

The construction of the solenoid operated valve operating mechanism 33 is believed to be conventional and will not be further described except to note that the valve operating mechanism 33 includes a fuel passage portion 41 which extends through a solenoid core 43 supporting a solenoid coil 44 and which communicates with an inlet end 45 of the fuel passage 21 and which has an outlet end 47.

The valve operating mechanism 33 also includes, in addition to the solenoid core 43, a disk-like armature 49 which is biased away from the solenoid core 47 by a suitable spring 51 and which includes therein suitable slots 53 affording fuel passage to the fuel passage portion 41 within the solenoid core 43 even when the disk-like armature 49 is magnetically engaged with the solenoid core 43.

The intermediate component 35 includes a bore 61 in alignment with and communicating with the fuel passage portion 41 in the solenoid core 43, which bore 61 includes an enlarged counterbore 63 which serves as a receptical for the inner end 65 of the nozzle 37. Also included in the intermediate component 35 is a duct 67 which extends transversely to, and communicates with, the counterbore 63 and which is adapted to be connected to the source 17 of compressed gas (preferably substantially air). Any suitable source 17 of compressed gas (air) at a substantially constant pressure can be employed.

The elongated nozzle 37 includes an annular outer member 71 which is preferably generally cylindrical and which provides wall means defining various surfaces and passage portions still to be described. In addition, the nozzle 37 also includes an inner member 73 which is also preferably generally cylindrical and which is fixed relative to the outer member 71 and which provides other wall means defining various other surfaces and passage portions still to be described.

More particularly, the wall means on the inner member 73 defines an exterior generally cylindrical surface 75 and an interior generally cylindrical surface 77 defining a bore providing a portion 79 of the fuel passage 21, which portion 79 includes an inlet 81 aligned with and communicating with the bore 61 in the intermediate component 35 which, in turn, as has already been pointed out, communicates with the outlet 47 of the fuel passage portion 41 in the solenoid core 43. At its lower or axially outer end, the wall means on the inner member 73 includes an inner frustro-conical surface 83 which diverges axially outwardly and which forms a valve seat 85 which is part of the solenoid controlled fuel supply valve 25.

In addition, the wall means provided on the inner member 73 also includes an outer frustro-conical surface 87 extending between the outer cylindrical surface 75 and the diverging inner frustro-conical surface 83 which provides the valve seat 85.

The outer 71 member, as already indicated, provides wall means defining an inner cylindrical surface 91 which is generally located in radially outwardly spaced relation to the outer surface 75 of the inner member 73 to define a portion 93 of the air passage 15. At its end located within the intermediate component 35, the outer member 71 includes a transverse bore 97 which communicates with the transverse duct 67 in the intermediate component 35 and with the space which is located between the outer and inner members 71 and 73, respectively, and which forms the air passage portion 93.

Adjacent the outer end of the outer member 71, the wall means provides a frustro-conical surface 97 which extends from the adjacent end of the cylindrical surface 91 and which, in part, is located in spaced relation to the outer frustro-conical surface 85 on the inner member 73 to define a diverging air passage portion 99 having an inlet provided by a neck or restriction 101 to the air flow and which, as a consequence, causes air flow at an increased speed. Thus the compressed gas or air travels in the divergent passage portion 99 at sonic velocity. The diverging air passage portion 99 also includes an outlet 103 which will hereinafter be referred to.

The inner frustro-conical surface 97 of the outer member 71 terminates in a cylindrical surface 111 which, in turn, extends to a blind converging conical surface 113. The cylindrical surface 111 forms, with the conical surface 113, a distribution chamber 115 which forms a part of the air passage 15, and which communicates, as will be described in greater detail, with the outlet 103 of the diverging air passage portion 99.

Extending in the outer member 71, between the conical surface 113 and an end surface 117 of the nozzle 37 are at least one, and preferably a plurality of, ducts or holes 119 which also form part of the air passage 15 and which communicate between the distribution chamber 115 and the engine cylinder 19 with which the fuel injector is associated.

The solenoid operating valve 25 which controls fuel flow comprises a valve member 125 including a valve head 127 connected to a stem 129 which extends axially in the fuel passage 21 and which is connected to the disk-like armature 69 so that armature movement toward the solenoid core 43 in response to electrical energization of the solenoid coil 44 and away from the solenoid core 43 in response to action of the spring 51 causes related movement of the valve head 127 between open and closed positions relative to the valve seat 85.

More particularly, the valve head 127 includes a frustro-conical surface or portion 131 which is sealingly engagable with the valve seat 85 to prevent fuel flow and a converging conical surface or portion 135 extending axially outwardly from the frustro-conical portion 131.

The conical portion 135 of the valve head 127 is spaced above the distribution chamber 115 and defines, with the inner converging frustro-conical surface 97 of the outer nozzle member 71 another diverging air passage portion 141 having an inlet in communication with the outlet 103 of the air passage portion 99 and having an outlet communicating with the distribution chamber 115.

When the valve head 127 is engaged with the valve seat 85, i.e., when in the closed position, the conical surface 135 of the valve head 127 forms an extension of the outer frustro-conical surface 85 of the inner member 73. When the valve head 127 is moved to the open position, the conical surface 135 of the valve head 127 projects somewhat into the air passage portion 141, i.e., reduces the size thereof, and causes some increase in turbulence in the continuous air flow, which increase in turbulence is thought to be helpful in atomizing the fuel as it enters transversely into the fuel passage portions 99 and 141 for conveyance with the air flow into the engine cylinder 19.

In operation, air flows continuously from the source 17 through the air flow passage 15 and out of the ducts 119 into the cylinder 19. In general, the volume of air continuously supplied through the air flow passage 15 and entering the cylinder 19 for each cycle can be about five to ten percent of the air required for combustion and can be about 5 percent of the engine air flow at wide open throttle. Upon energization of the solenoid coil 44, a suitable quantity of fuel flows in a conical stream into the air flowing through the passage portions 99 and 141. Such introduction of fuel transversely into the divergent flow of high velocity compressed gas or air causes effective atomization of the fuel and conveyance thereof with the gas or air into the cylinder 9.

Suitable spacer means can be provided between the inner member 73 and the outer member 71 so long as such as spacers, as shown at 151, do not substantially inhibit gas flow.

At its upper end, the inner member 73 includes an enlarged portion 161 which is received in a counterbore 163 in the outer member 71 so as to fixedly locate at least the upper end of the inner member 73 in relation to the outer member 71.

Suitable gaskets or seals can be provided as shown at 171 to prevent air or fuel flow other than through the described air and fuel passages 15 and 21 respectively, and to prevent escape of gas from the cylinder 9.

The disclosed construction eliminates use of an air valve and mechanism for operating the air valve, while at the same time, provides good atomization of the incoming fuel and conveyance thereof into the engine cylinder 19 even with fuel ejection durations of less than about four milliseconds.

Various of the features of the invention are set forth in the following claims.

I claim:

1. A fuel injector nozzle comprising an inner member including an axially extending fuel passage adapted to communicate with a source of fuel under pressure and having an outlet end with an axially outwardly diverging frustro-conical inner surface defining a valve seat, said inner member also including a frustro-conical outer surface converging to said diverging frustro-conical inner surface, an outer member surrounding said inner member in spaced relation thereto and defining therebetween an air flow passage adapted to communicate with a source of air under pressure, said outer member including an axially outwardly extending and converging frustro-conical surface located in spaced relation to said frustro-conical outer surface of said inner member and forming, with said frustro-conical outer surface of said inner member, a first diverging portion of said air flow passage, and a valve member located in said fuel passage and movable axially thereof relative to said valve seat between open and closed positions, said valve member comprising a valve head including an axially outwardly diverging frustro-conical surface engagable with said valve seat when said valve member is in said closed position and spaced from said valve seat when said valve member is in said open position, said valve head also including an axially outwardly extending converging conical surface located in spaced relation to said frustro-conical surface of said outer member and forming, with said frustro-conical surface of said outer member, a second diverging portion of said air flow passage, said second diverging air flow passage portion communicating with said first diverging air flow passage portion and with the environment exterior to said outer member.

2. A fuel injector nozzle comprising an inner member including an axially extending fuel passage adapted to communicate with a source of fuel under pressure and having an outlet end with an axially outwardly diverging frustro-conical surface defining a valve seat, said inner member also including an outer surface which is endless transversely of said fuel passage, and a frustro-conical outer surface converging from said outer surface to said diverging frustro-conical inner surface, an outer member surrounding said outer surface of said inner member in spaced relation thereto and defining therebetween an air flow passage adapted to communicate with a source of air under pressure, said outer member including an axially outwardly extending and converging frustro-conical surface located in spaced relation to said frustro-conical outer surface of said inner member and forming, with said frustro-conical outer surface of said inner member, a first diverging portion of said air flow passage, said first divergent air flow passage portion including an entry end constituting a restriction to air flow and outlet end, said outer member also including, axially outwardly of said frustro-conical surface thereof, an annular distribution chamber forming a part of said air flow passage, and said outer member also including an air flow duct forming a part of said air flow passage and communicating with said distribution chamber and with the environment exterior to said outer member, and a valve member located in said fuel passage and movable axially thereof relative to said valve seat between open and closed positions, said valve member comprising a valve head including an axially outwardly diverging frustro-conical surface engagable with said valve seat when said valve member is in said closed position and spaced from said valve seat when said valve member is in said open position, said valve head also including an axially outwardly extending converging conical surface located above said distribution chamber and in spaced relation to said frustro-conical surface of said outer member and forming, with said frustro-conical surface of said outer member, a second diverging portion of said air flow passage, said second diverging air flow passage portion including a entry end communicating with said outlet end of said first diverging air flow passage portion and an outlet end communicating with said distribution chamber.

3. A fuel injector comprising first annular wall means defining an axially extending fuel passage adapted to communicate with a source of fuel under pressure and including an outlet end having an axially outwardly diverging frustro-conical inner surface defining a valve seat, said first annular wall means also including an outer surface which is endless transversely of said fuel passage, and a frustro-conical outer surface converging from said outer surface to said diverging frustro-conical inner surface, a valve member located in said fuel passage and movable axially thereof relative to said valve seat between open and closed positions, said valve member comprising a valve head including an axially outwardly diverging frustro-conical surface engagable with said valve seat when said valve member is in said closed position and spaced from said valve seat when said valve member is in said open position, said valve head also including an axially outwardly extending converging conical surface, and second annular wall means surrounding said outer surface of said first annular wall means in spaced relation thereto and defining therebetween an air flow passage adapted to communicate with a source of air under pressure, said second annular wall means defining an axially outwardly extending and converging frustro-conical surface located in spaced relation to said frustro-conical outer surface of said first annular wall means and forming, with said frustro-conical outer surface of said first annular wall means, a first diverging portion of said air flow passage, said first divergent air flow passage portion having an entry end constituting a restriction to air flow and an outlet end, said converging frustro-conical surface of said second annular wall means also being located in spaced relation to said conical surface of said valve head and forming, with said conical surface of said valve head, a second diverging portion of said air flow passage, which second diverging air flow passage portion includes an entry end communicating with said outlet end of said first diverging air flow passage portion and an outlet end, said second annular wall means also defining, axially outwardly of said conical portion of said valve head, an annular distribution chamber forming a part of said air flow passage and communicating with said outlet end of said second diverging air flow passage portion, and said second annular wall means also defining an air flow duct forming a part of said air flow passage and communicating with said distribution chamber and with the environment exterior to said second annular wall means.

4. A fuel injector nozzle comprising an inner member including an axially extending fuel passage adapted to communicating with a source of fuel under pressure and having an outlet end with a surface defining a valve seat, said inner member also including an outer surface extending axially outwardly and coverging to said valve seat, a valve member located in said fuel passage and movable axially thereof relative to said valve seat between open and closed positions, said valve member comprising a valve head engagable with said valve seat when said valve member is in said closed position and spaced from said valve seat when said valve member is in said open position, said valve head including an axially outwardly extending and converging surface, and an outer member surrounding said inner member and said valve head in spaced relation thereto and defining therebetween an air flow passage adapted to communicate with a source of air under pressure, said outer member including an axially outwardly extending and converging surface located in spaced relation to said outer surface of said inner member and to said converging surface of said valve head and forming, with said outer surface of said inner member and said converging surface of said valve head, an air flow passage portion which diverges axially outwardly and which communicates with said fuel passage when said valve seat is in said open position and with the environment exterior to said outer member.

5. A fuel injector nozzle comprising an inner member including an axially extending fuel passage adapted to communicate with a source of fuel under pressure and having an outlet end with a surface defining a valve seat, said inner member also including an outer surface extending axially outwardly and coverging to said valve seat, a valve member located in said fuel passage and movable axially thereof relative to said valve seat between open and closed positions, said valve member comprising a valve head engagable with said valve seat when said valve member is in said closed position and spaced from said valve seat when said valve member is in said open position, said valve head including an axially outwardly extending and converging surface, and an outer member surrounding said inner member and said valve head in spaced relation thereto and defining therebetween an air flow passage adapted to communicate with a source of air under pressure, said outer member including an axially outwardly extending and converging surface located in spaced relation to said outer surface of said inner member and to said converging surface of said valve head and forming, with said outer surface of said inner member and said converging surface of said valve head, an air flow passage portion which diverges axially outwardly and which communicates with said fuel passage when said valve seat is in said open position, said outer member also including an annular distribution chamber forming a part of said air flow passage, and an air flow duct forming a part of said air flow passage and communicating with said distribution chamber and with the environment exterior to said outer member.

* * * * *